US010487838B2

(12) United States Patent
Pruitt et al.

(10) Patent No.: US 10,487,838 B2
(45) Date of Patent: Nov. 26, 2019

(54) DEVICES AND METHOD FOR ADJUSTING TURBOCHARGER ROTATING ASSEMBLY BALANCE

(71) Applicant: BorgWarner Inc., Auburn Hills, MI (US)

(72) Inventors: Daniel Pruitt, Boiling Springs, SC (US); Evan Lucas, Asheville, NC (US); David Ledger, Asheville, NC (US); Matt Tondra, Fletcher, NC (US)

(73) Assignee: BorgWarner, Inc., Auburn Hills, MI (US)

( * ) Notice: Subject to any disclaimer, the term of this patent is extended or adjusted under 35 U.S.C. 154(b) by 440 days.

(21) Appl. No.: 14/868,444

(22) Filed: Sep. 29, 2015

(65) Prior Publication Data

US 2016/0097395 A1 Apr. 7, 2016

Related U.S. Application Data

(60) Provisional application No. 62/059,235, filed on Oct. 3, 2014.

(51) Int. Cl.

| | |
|---|---|
| ***F04D 25/04*** | (2006.01) |
| ***F04D 17/10*** | (2006.01) |
| ***F02B 37/12*** | (2006.01) |
| ***F04D 25/02*** | (2006.01) |
| ***F04D 29/66*** | (2006.01) |

(52) U.S. Cl.

CPC ..... *F04D 17/10* (2013.01); *F04D 25/024* (2013.01); *F04D 29/662* (2013.01); *F05D 2220/40* (2013.01)

(58) Field of Classification Search

CPC ..... F04D 17/10; F04D 25/024; F04D 29/662; F05D 2220/40; G01M 1/36; B60B 30/00

USPC ..... 417/407; 409/131

See application file for complete search history.

(56) References Cited

U.S. PATENT DOCUMENTS

| | | | | |
|---|---|---|---|---|
| 1,645,343 | A * | 10/1927 | Moorhouse | F16F 15/34 464/180 |
| 3,621,621 | A * | 11/1971 | Husack | B24B 45/00 451/342 |
| 4,835,827 | A | 6/1989 | Marra | |
| 4,842,485 | A | 6/1989 | Barber | |
| 4,879,792 | A | 11/1989 | O'Connor | |
| 5,074,723 | A * | 12/1991 | Massa | B23B 31/006 279/129 |

(Continued)

OTHER PUBLICATIONS

Bolt Science, "The Use of Two Nuts to Prevent Self Loosening", Mar. 21, 2011, Bolt Science (Year: 2011).*

*Primary Examiner* — Dominick L Plakkoottam
*Assistant Examiner* — Connor J Tremarche
(74) *Attorney, Agent, or Firm* — BrooksGroup

(57) ABSTRACT

An annular balance adjusting device (50) is included in the clamping region of a turbocharger (1) rotating assembly. The annular balance adjusting device (50) includes an annular member (51, 61) having a non-uniform weight distribution. By setting the rotational orientation of the annular member (51, 61) relative to the rotating assembly ((not labeled)), imbalance of the rotating assembly can be addressed. The annular balance adjusting device (50) can be used to correct the imbalance of the rotating assembly, thereby reducing turbocharger (1) vibration and increasing turbocharger (1) durability.

10 Claims, 7 Drawing Sheets

(56) References Cited

U.S. PATENT DOCUMENTS

| | | | | |
|---|---|---|---|---|
| 5,273,398 | A * | 12/1993 | Reinfelder | B64C 27/008 416/144 |
| 5,810,527 | A * | 9/1998 | Jager | B23C 5/006 408/143 |
| 5,931,050 | A * | 8/1999 | Roach | B23B 5/02 464/180 |
| 6,471,453 | B1 * | 10/2002 | Winebrenner | B23B 31/00 408/143 |
| 6,640,704 | B2 | 11/2003 | Siebolds et al. | |
| 2006/0013693 | A1 * | 1/2006 | Meacham | F01D 5/025 416/244 R |
| 2012/0227536 | A1 * | 9/2012 | Jewett | F16F 15/3153 74/572.2 |
| 2012/0321458 | A1 * | 12/2012 | Allen | F04D 29/266 415/229 |
| 2013/0236292 | A1 | 9/2013 | Milner | |

* cited by examiner

FIG. 2
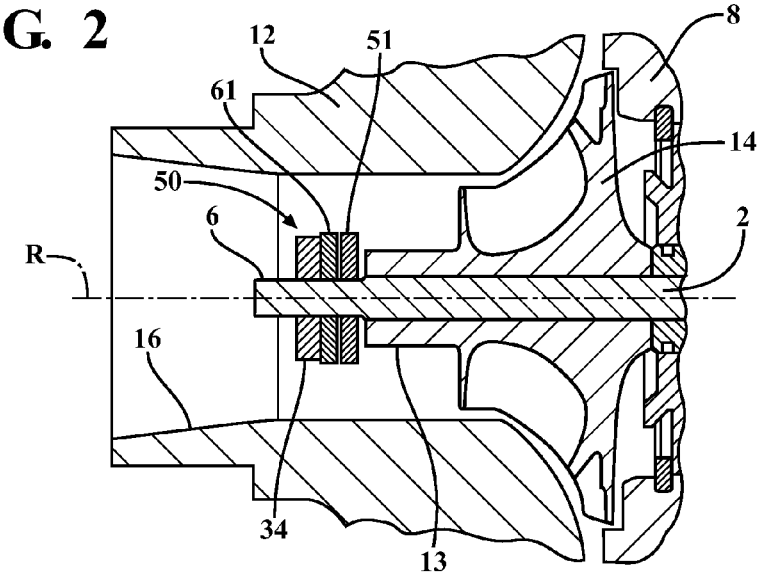
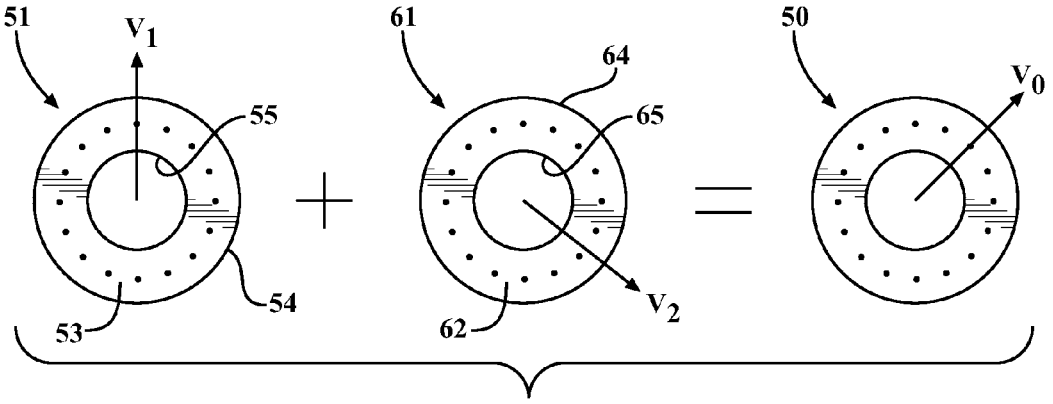
FIG. 3
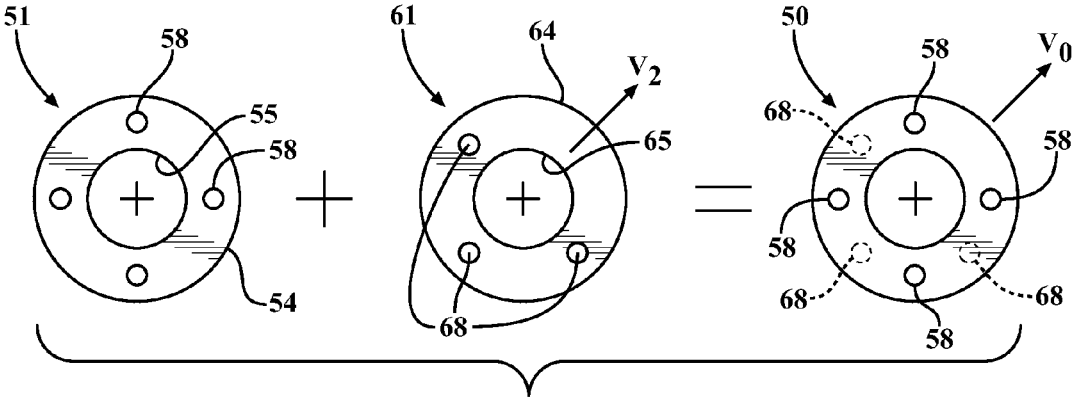
FIG. 4

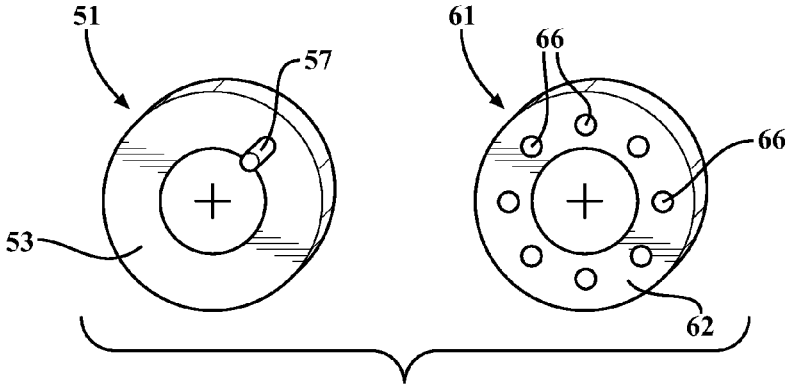
FIG. 8
FIG. 9
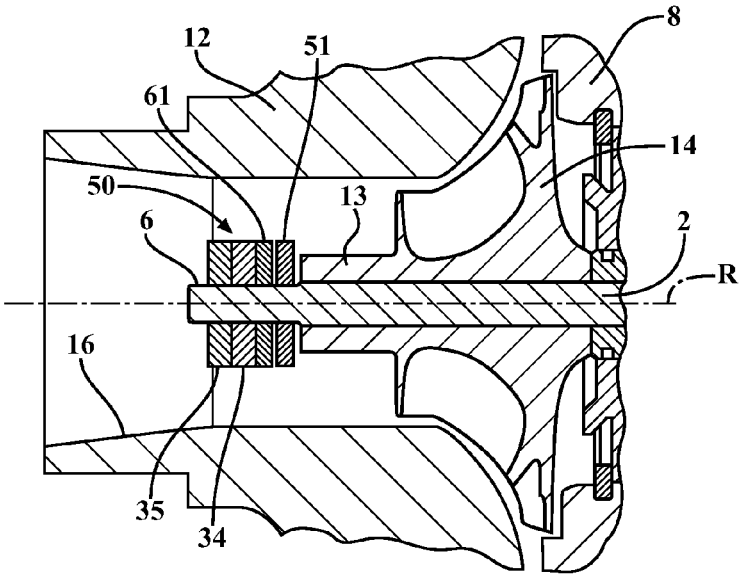
FIG. 10
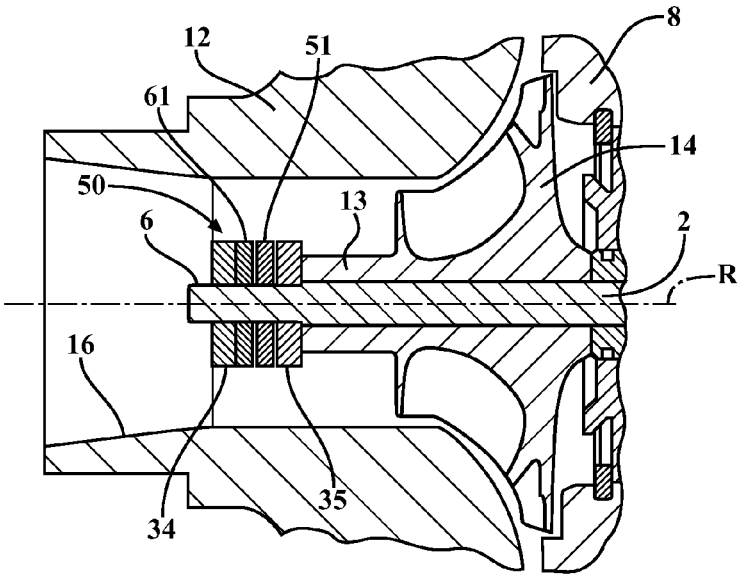

DEVICES AND METHOD FOR ADJUSTING TURBOCHARGER ROTATING ASSEMBLY BALANCE

CROSS-REFERENCE TO RELATED APPLICATIONS

This application claims priority to and all the benefits of U.S. Provisional Application No. 62/059,235, filed on Oct. 3, 2014, and entitled "Devices and Method for Adjusting Turbocharger Rotating Assembly Balance", which is incorporated herein by reference.

FIELD OF THE INVENTION

This invention eliminates a potential source of imbalance in high speed rotating assemblies, and in particular in rotating assemblies used in turbochargers.

BACKGROUND

A turbocharger is a type of forced induction system used with internal combustion engines. Turbochargers deliver compressed air to an engine intake, allowing more fuel to be combusted, thus boosting the horsepower of the engine without significantly increasing engine weight. As such, turbochargers permit the use of smaller engines that develop the same amount of horsepower as larger, normally aspirated engines. Using a smaller engine in a vehicle has the desired effect of decreasing the mass of the vehicle, increasing performance, and enhancing fuel economy. Moreover, the use of turbochargers permits engine downsizing which results in reduced $CO_2$ emissions, a highly desirable goal for the environment.

Turbochargers typically include a turbine housing connected to the exhaust manifold of the engine, a compressor housing connected to the intake manifold of the engine, and a center bearing housing disposed between and coupling the turbine and compressor housings together. A turbine wheel in the turbine housing is rotatably driven by an inflow of exhaust gas supplied from the exhaust manifold or cylinder head. A shaft is radially supported for rotation in the center bearing housing, and connects the turbine wheel to a compressor impeller in the compressor housing so that rotation of the turbine wheel causes rotation of the compressor impeller. The shaft connecting the turbine wheel and the compressor impeller defines a line which is the axis of rotation. As the compressor impeller rotates, it increases the air mass flow rate, airflow density and air pressure delivered to the cylinders of the engine via the engine intake manifold.

During operation of the turbocharger, the rotating assembly of the turbocharger, comprising turbine wheel, compressor wheel, and connecting shaft, may rotate at 10,000 RPM to 300,000 RPM or more. As part of the turbocharger manufacturing process, the rotating assembly is balanced to reduce vibration, thus improving turbocharger durability. In this regard, the turbine wheel is materially fused to the shaft to make a unitary shaft-and-wheel assembly. The shaft-and-wheel assembly can be accurately machined with shaft diameters ground to tolerances in the 2.5 micron regime; thus, an inherent balance of the shaft-and-wheel assembly is generally within acceptable limits for some applications. In other applications, some component balancing may be required. The compressor wheel, on the other hand, is an extremely difficult part to machine and balance. In addition, the compressor wheel is secured to the free end of the shaft of the shaft-and-wheel assembly via a nut, whereby further imbalance can sometimes be introduced into the rotating assembly.

SUMMARY

In some aspects, an annular balance adjusting device includes two or more washers of known imbalance that are disposed on the compressor wheel-end of the shaft at a location outboard relative to the compressor wheel, where the term "outboard" refers to being further from the turbine housing of the turbocharger, and the term "inboard" refers to being closer to the turbine housing of the turbocharger. The rotational orientation of the washers relative to each other, and the relative rotational orientation of the group of washers relative to the rotating assembly is set to correspond to a desired balance change, which in some examples offsets a measured imbalance of the rotating assembly. By this approach, adjustment of the balance of the rotating assembly is performed without a machining process that includes removal of material from the compressor nut. Moreover, the adjustment process can be performed manually and in the field. By removing the machining operations from the balancing process, the time, complexity, required expertise required for turbocharger balancing are reduced. In addition, the potential for turbocharger contamination is also reduced since there is no longer a need to remove material from the compressor nut by machining and infiltration of machining chips and debris into the turbocharger is avoided.

Moreover, the annular balance adjusting device permits adjustment of the balance of the turbocharger without removal of the turbocharger from the vehicle. This is advantageous, since it permits adjustment, and readjustment, of the balance of the turbocharger over its operational life. For example, by providing the annular balance adjusting device on the rotating assembly, imbalance increases due to operation and wear of the turbocharger (e.g., migration) can be corrected in the field without removal of the turbocharger from the vehicle, thus reducing time required for servicing the engine system.

Rather than reducing rotating assembly imbalance, the annular balance adjusting device can alternatively be used to quickly and reversibly generate imbalance and/or control the level of imbalance in the rotating assembly for testing purposes. For example, the ability to quickly, reversibly and adjustably control rotating assembly imbalance can be beneficial when it is necessary to correlate the sensitivity of the acoustics of the entire vehicle to the imbalance of the turbocharger. The annular balance adjusting device permits adjustment of the imbalance of a single turbocharger which remains installed in the vehicle and can present with multiple imbalance levels. This can be compared to some conventional methods of correlating the sensitivity of the acoustics of the entire vehicle to the imbalance of the turbocharger in which multiple turbochargers of varying imbalance level are sequentially tested within the vehicle.

The rotating assembly includes a shaft having a first end, a second end and a rotational axis that extends through the first end and the second end. The rotating assembly includes a turbine wheel rigidly connected to the second end of the shaft, a compressor wheel disposed on the shaft such that a nose of the compressor wheel is adjacent to the first end of the shaft, a nut that engages the first end of the shaft so as to secure the compressor wheel to the first end of the shaft, and the annular balance adjusting device disposed on the shaft between the nose and the first end of the shaft. The annular balance adjusting device has a predetermined non-uniform mass distribution along its circumference, and is configured to be selectively rotated about the rotational axis relative to the nose so as to adjust the balance of the rotating assembly.

In some aspects, the annular balance adjusting device is selectively rotatable about the rotational axis between predetermined discrete rotational orientations relative to the nose. The annular balance adjusting device includes a first washer and a second washer that is selectively rotatable relative to the first washer. Each of the first washer and the second washer has a predetermined non-uniform mass distribution along its respective circumference. The first washer has a first set of surface features on a first side thereof that cooperate with surface features provided on the nose to retain the first washer in a desired rotational orientation relative to the nose, and a second set of surface features on a second side thereof that cooperate with surface features provided on the second washer to retain the first washer in a desired rotational orientation relative to the second washer. The first set of surface features comprise one of detents and protrusions, and the surface features provided on the nose comprise the other of the detents and protrusions, and the second set of surface features comprises one of detents and protrusions, and the surface features provided on the second washer comprise the other of the detents and protrusions. The annular balance adjusting device is disposed on the shaft between the nut and the nose, and the nut is used to retain the annular balance adjusting device in a desired rotational orientation relative to the nose. The annular balance adjusting device includes a first washer and a second washer that is selectively rotatable relative to the first washer. Each of the first washer and the second washer has a predetermined non-uniform mass distribution along its respective circumference. A fastener secures the first washer and the second washer to the shaft and maintains the first washer in a desired rotational orientation with respect to the second washer.

In some aspects, the nut includes a compressor wheel-facing surface, an axially outward-facing surface that is opposed to the compressor wheel-facing surface, and an outer edge that extends between the compressor wheel-facing surface and the axially outward-facing surface. The annular balance adjusting device comprises a hollow cylindrical collar that encloses the axially outward-facing surface of the nut and at least a portion of the outer edge of the nut. The collar comprises a predetermined non-uniform mass distribution along its circumference, and includes a fastener that secures the collar to the nut. The outer edge of the nut includes nut surface features that are configured to engage corresponding collar surface features formed on an inner surface of the collar so as to rotationally locate the collar relative to the nut. The nut surface features comprise axially-extending grooves formed on at least a portion of the outer edge of the nut, and the collar surface features comprise axially-extending grooves formed on the inner surface of the collar.

In some aspects, the nut comprises a compressor wheel-facing surface, an axially outward-facing surface that is opposed to the compressor wheel-facing surface, and an outer edge that extends between the compressor wheel-facing surface and the axially outward-facing surface. The annular balance adjusting device comprises a hollow cylindrical collar that encloses the axially outward-facing surface and at least a portion of the outer edge. The collar includes a predetermined non-uniform mass distribution along its circumference, and includes an elastic member disposed between the collar and the axially outward-facing surface. The elastic member provides a spring force that urges the collar to move axially along the shaft in a direction away from the compressor wheel. The nose comprises a radially outward-protruding flange and the collar includes a radially inward-protruding lip wherein the collar encircles the radially outward-protruding flange such that the radially outward-protruding flange is disposed between the radially inward-protruding lip and a closed end face of the collar. The radially inward-protruding lip is urged against the radially outward-protruding flange via the spring force of the elastic member and the collar is retained on the nose by engagement of the radially inward-protruding lip with the radially outward-protruding flange. The outer edge of the nut includes nut surface features that are configured to engage corresponding collar surface features formed on an inner surface of the collar so as to rotationally locate the collar relative to the nut. The collar is configured to move relative to the nose between a first position in which the radially inward-protruding lip is urged against the radially outward-protruding flange via the spring force of the elastic member and the collar is axially retained on the nose by engagement of the radially inward-protruding lip with the radially outward-protruding flange, and a second position in which the radially inward-protruding lip is axially spaced apart from the radially outward-protruding flange and the nut surface features no longer engage the corresponding collar surface features, so as to permit rotation of the collar about the rotational axis relative to the nose, and wherein the elastic member biases the collar to the first position. The rotational orientation of the collar relative to the nose is fixed via engagement of the nut surface features with the corresponding collar surface features.

In some aspects, a turbocharger includes a bearing housing that rotatably supports a shaft including a first end, a second end and a rotational axis that extends through the first end and the second end. The turbocharger includes a turbine wheel that is rigidly connected to the second end of the shaft, a compressor wheel disposed on the shaft such that a nose of the compressor wheel is adjacent to the first end of the shaft. The compressor wheel, the turbine wheel and the shaft, together provide a rotating assembly of the turbocharger. A nut engages the first end of the shaft so as to secure the compressor wheel to the first end of the shaft. The turbocharger further includes an annular balance adjusting device disposed on the shaft between the nose and the first end of the shaft. The annular balance adjusting device has a predetermined non-uniform mass distribution along its circumference, and is configured to be selectively rotated about the rotational axis relative to the nose so as to adjust the balance of the rotating assembly.

In some aspects, a method for adjusting the balance of a rotating assembly is provided. The rotating assembly includes a shaft, a turbine wheel fixed to one end of the shaft, and a compressor wheel secured to an opposed end of the shaft via a nut. The method includes providing an annular balance adjusting device on the opposed end of the shaft, the annular balance adjusting device having a predetermined non-uniform mass distribution along its circumference, where the annular balance adjusting device is configured to be selectively rotated about a rotational axis of the shaft relative to the compressor wheel. The method further includes rotating the annular balance adjusting device about the rotational axis relative to the compressor wheel so as to adjust the balance of the rotating assembly.

The method may involve the annular adjusting device including at least the following features: a first washer and a second washer that is selectively rotatable relative to the first washer; each of the first washer and the second washer having a predetermined non-uniform mass distribution along its respective circumference; the first washer has a first set of surface features on a first side thereof that cooperate with surface features provided on the nose to retain the first washer in a desired rotational orientation relative to the nose; and a second set of surface features on a second side thereof that cooperate with surface features provided on the second washer to retain the first washer in a desired rotational orientation relative to the second washer. Moreover, the method may include the steps of determining a balance change vector that corresponds to a magnitude and direction of a desired balance change to be applied to the rotational assembly; selecting a rotational orientation of the first washer relative to the compressor wheel corresponding to a first imbalance vector and a rotational orientation of the second washer relative to the compressor wheel corresponding to a second imbalance vector such that the sum of the first imbalance vector and the second imbalance vector is made equal to the balance change vector; and securing the first washer and the second washer to the rotating assembly such that the rotational orientation of the first washer relative to the compressor wheel and the rotational orientation of the second washer relative to the compressor wheel are maintained.

BRIEF DESCRIPTION OF THE DRAWINGS

The present invention is illustrated by way of example and not limitation in the accompanying drawings in which like reference numbers indicate similar parts, and in which:

FIG. 2 is an enlarged cross-sectional view of the clamping region of the rotating assembly showing the annular balance adjusting device;

FIG. 3 is a schematic illustration of selection of adjustment angles of washers of the annular balance adjusting device to provide a known overall imbalance vector;

FIG. 4 is an end view of the washers of the annular balance adjusting device including axial openings used to provide washer imbalance;

FIG. 8 is a perspective view of the washers of the annular balance adjusting device including protrusions and detents formed on axial surfaces and used to retain relative rotational orientations of the washers;

FIG. 9 is an enlarged cross-sectional view of the clamping region of the rotating assembly showing an alternative configuration of the annular balance adjusting device of FIG. 1;

FIG. 10 is an enlarged cross-sectional view of the clamping region of the rotating assembly showing another alternative configuration of the annular balance adjusting device of FIG. 1;

DETAILED DESCRIPTION

Figure 1:
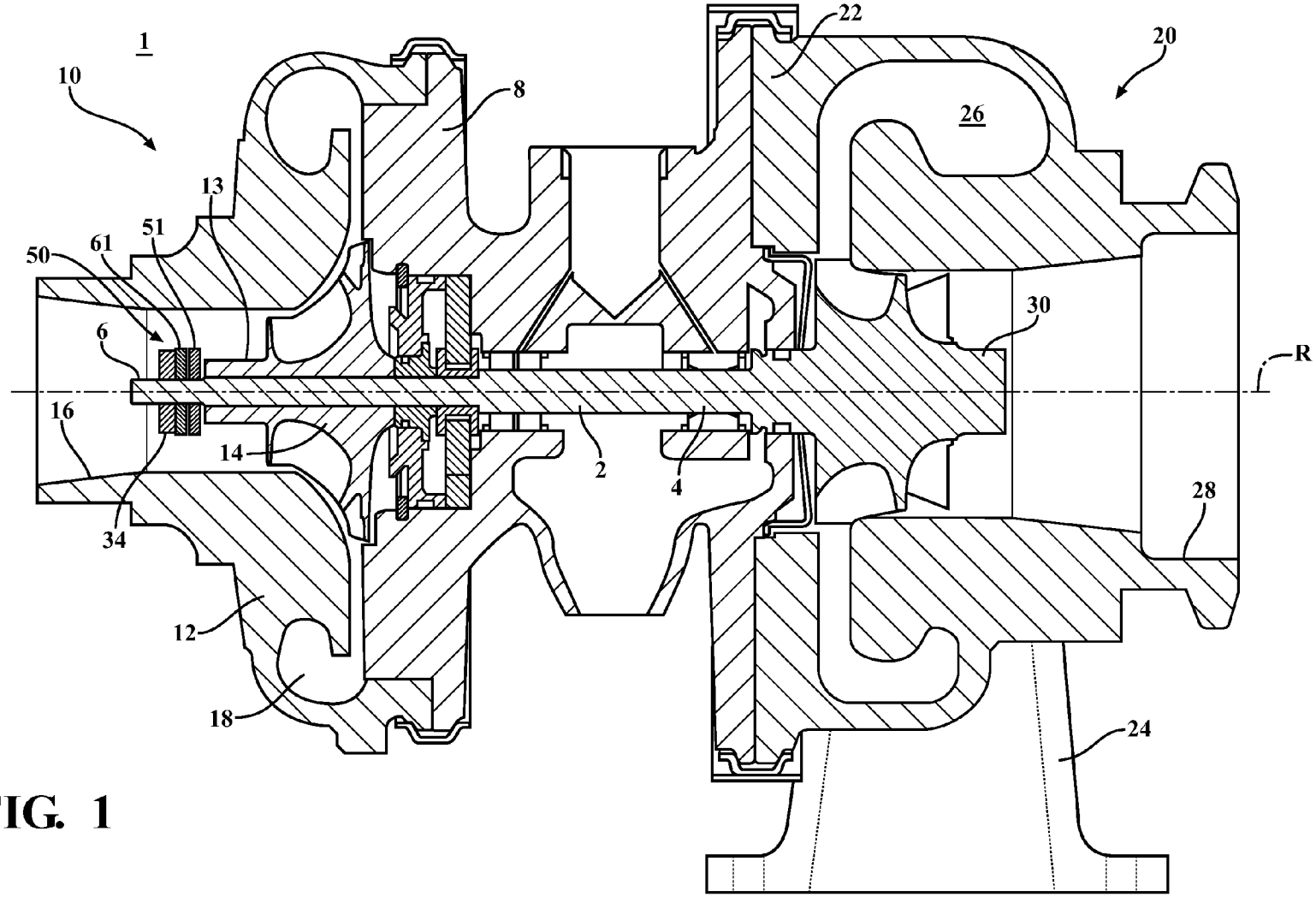
FIG. 1 is a cross-sectional view of an exhaust gas turbocharger including an annular balance adjusting device in the clamping region of the rotating assembly.

Referring to FIGS. 1 and 2, an exhaust gas turbocharger 1 includes a compressor section 10, a turbine section 20, and a center bearing housing 8 disposed between and connecting the compressor section 10 to the turbine section 20. The turbine section 20 includes a turbine housing 22 that defines an exhaust gas inlet 24, an exhaust gas outlet 28, and a turbine volute 26 disposed in the fluid path between the exhaust gas inlet 24 and exhaust gas outlet 28. A turbine wheel 30 is disposed in the turbine housing 22 between the turbine volute 26 and the exhaust gas outlet 28. The turbine wheel 30 is fixed to an end 4 of a shaft 2 for example by welding. The shaft 2 is rotatably supported within in the bearing housing 8, and extends into the compressor section 10. The compressor section 10 includes a compressor housing 12 that defines an air inlet 16, an air outlet (not shown), and a compressor volute 18. A compressor wheel 14 is disposed in the compressor housing 12 between the air inlet 16 and the compressor volute 18. The compressor wheel 14 is disposed on an opposed, stub end 6 of the shaft 2, and secured to the stub end 6 by a nut 34. The turbine wheel 30, the compressor wheel 14, and the shaft 2 together form the rotating assembly (not labeled) of the turbocharger 1.

In use, the turbine wheel 30 in the turbine housing 22 is rotatably driven by an inflow of exhaust gas supplied from the exhaust manifold of an engine. Since the turbocharger shaft 2 is rotatably supported in the bearing housing 8 and connects the turbine wheel 30 to the compressor wheel 14, the rotation of the turbine wheel 30 causes rotation of the compressor wheel 14 within the compressor housing 12. As the compressor wheel 14 rotates, it increases the air mass flow rate, airflow density and air pressure delivered to the engine's cylinders via an outflow from the compressor air outlet, which is connected to the engine's intake manifold.

The turbocharger 1 further includes an annular balance adjusting device 50 disposed on the shaft 2 between the compressor wheel 14 and the stub end 6 of the shaft 2. The annular balance adjusting device 50 is retained on the shaft stub end 6 via the nut 34. The annular balance adjusting device 50 is selectively rotatable about the rotational axis R between predetermined discrete rotational orientations relative to the compressor wheel 14 and shaft 2 to permit adjustment of the imbalance level of the rotating assembly (not labeled) of the turbocharger 1, as discussed further below.

Referring to FIG. 3, the annular balance adjusting device 50 includes a first washer 51, and a second washer 61 that is selectively rotatable relative to the first washer 51. The first washer 51 is a thin, disc-shaped plate having a central opening 55. The first washer 51 includes a first side 52 (not shown) that faces the compressor wheel nose 13, and a second side 53 that is opposed to the first side 52 (not shown) and faces the second washer 61. Similarly, the second washer 61 is a thin, disc-shaped plate having a central opening 65. The second washer 61 includes a first side 62 that faces the first washer 51, and a second side 63 (not shown) that is opposed to the first side 62 and faces the nut 34. Each of the first and second washers 51, 61 have an outer diameter defined by an outer peripheral edge 54, 64 that corresponds generally to an outer diameter of a nose 13 of the compressor wheel 14, and an inner diameter that corresponds generally to an outer diameter of the shaft stub end 6 with minimal clearance.

Each of the first washer 51 and the second washer 61 also has a predetermined, non-uniform mass distribution along a circumference thereof. The mass distribution (e.g., magnitude and direction) of the first washer 51 can be represented by a first vector V1. Likewise, the mass distribution of the second washer can be represented by a second vector V2. When the first washer 51 is arranged with the second washer 61 in a stacked configuration and in a given relative rotational orientation, the sum of first and second vectors V1, V2 corresponds to an overall imbalance vector Vo that represents the magnitude and direction of imbalance that is provided by the annular balance adjusting device 50 when the washers 51, 61 are in the given orientation. The overall imbalance of the annular balance adjusting device 50 can be selected by strategically selecting the relative orientations of the first and second washers 51, 61.

Referring to FIG. 4, there are many ways to achieve the predetermined non-uniform mass distribution of the washers 51, 61. In some embodiments, each of the first and second washers 51, 61 have one or more weight distributing openings 58, 68 disposed between the central opening 55, 65 and the outer peripheral edge 54, 64 thereof that function to provide a known, imbalanced weight distribution about a circumference of the washer 51, 61. In particular, the arrangement of the openings (e.g., size, shape, location, and orientation) is selected to provide a predetermined non-uniform mass distribution along a circumference of the washer 51, 61.

In one example, the weight distributing openings 58, 68 extend axially. In this example, the mass distribution of the first washer 51 is different than that of the second washer 61, but the washers 51, 61 are not limited to this. The first washer 51 includes four axial weight distributing openings 58 that are disposed mid-way between the central opening 55 and the outer peripheral edge 54, and are spaced apart along a circumference of the first washer 51, resulting in a first washer imbalance vector V1. The second washer 61 includes three axial weight distributing openings 68 that are disposed mid-way between the central opening 65 and the outer peripheral edge 64, resulting in a first washer imbalance vector V2. Although the weight distributing openings 68 are spaced apart along a circumference of the second washer 61, they are grouped within a common semi-circular region of the second washer 61.

Figure 5:
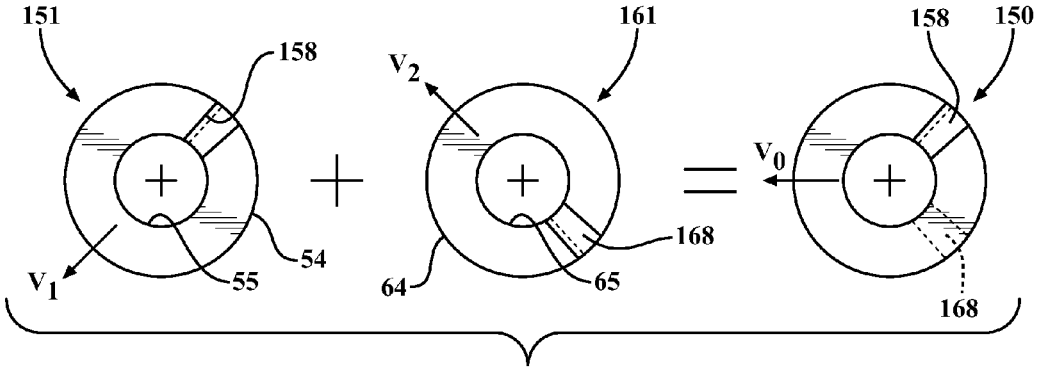
FIG. 5 is an end view of an alternative embodiment of the washers of the annular balance adjusting device including radial openings used to provide washer imbalance.

Referring to FIG. 5, in another example, the weight distributing openings 158, 168 extend radially. In this example, the mass distribution of the first washer 151 is the same as that of the second washer 161, but the washers 151, 161 are not limited to this. The first washer 151 includes at least one radially-extending weight distributing opening 158 that extends between the central opening 55 and the outer peripheral edge 54 resulting in a first washer imbalance vector V1. The second washer 161 includes at least one radially-extending weight distributing opening 168 that extends between the central opening 65 and the outer peripheral edge 64, resulting in a second washer imbalance vector V2.

Figure 6:
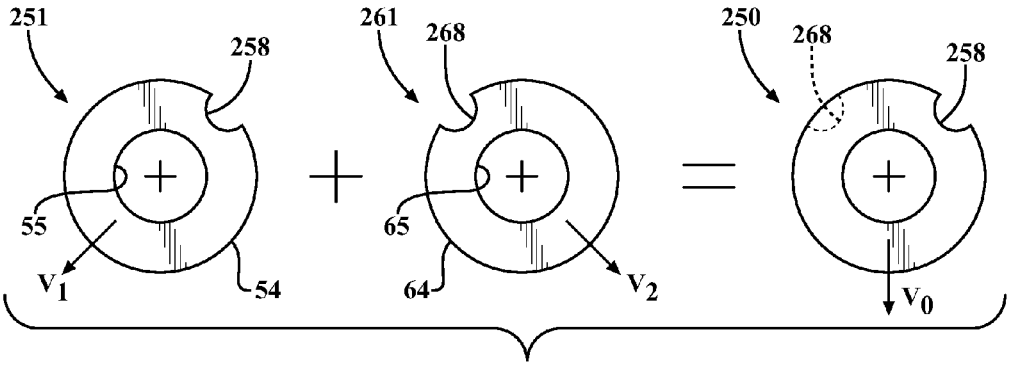
FIG. 6 is an end view of another alternative embodiment of the washers of the annular balance adjusting device including scallops formed in the washer peripheral edge to provide washer imbalance.

Referring to FIG. 6, in still another example, the weight distributing openings 258, 268 extend radially to a limited extent. In this example, the mass distribution of the first washer 251 is the same as that of the second washer 261, but the washers 251, 261 are not limited to this. The first washer 251 includes at least one scallop-shaped, weight distributing opening 258 formed in the outer peripheral edge 54, resulting in a first washer imbalance vector V1. The second washer 261 includes at least one scallop-shaped, weight distributing opening 268 formed in the outer peripheral edge 64, resulting in a second washer imbalance vector V2.

Figure 7:
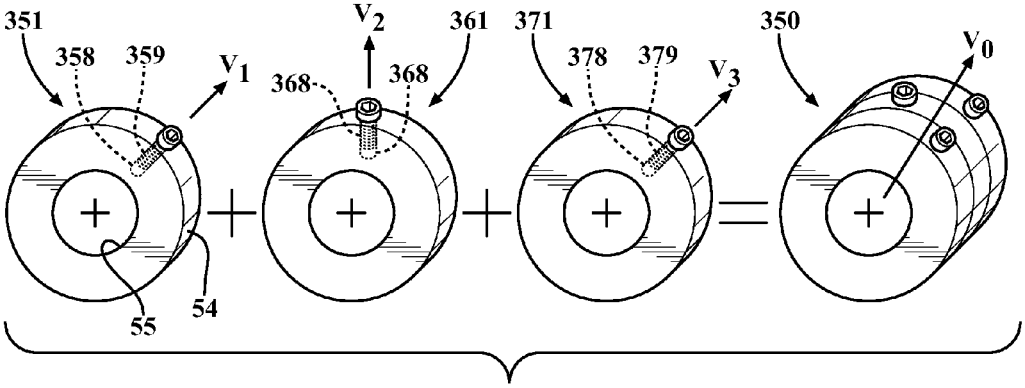
FIG. 7 is a perspective view of another alternative embodiment of the washers of the annular balance adjusting device including a localized mass in the form of a set screw to provide washer imbalance.

Referring to FIG. 7, in still another example, an annular balance adjusting device 350 includes three washers 351, 361, 371, and each washer 351, 361, 371 includes a single radially-extending weight distributing opening 358, 368, 378. The weight distributing openings 358, 368, 378 are threaded. The first washer 351 includes a first weight distributing screw 359 disposed in the weight distributing opening 358, resulting in a first washer imbalance vector V1. The second washer 361 includes a second weight distributing screw 369 disposed in the weight distributing opening 368, resulting in a second washer imbalance vector V2. The third washer 371 includes a third weight distributing screw 379 disposed in the weight distributing opening 378, resulting in a third washer imbalance vector V3. The weight distribution vector V1, V2, V3 of each washer 351, 361, 371 can be set by adjusting one or more of a) the length, b) the mass, and c) the relative position within the opening 358, 368, 378 of the respective weight distributing screw 359, 369, 379.

In the embodiment illustrated in FIGS. 1 and 2, the annular balance adjusting device 50 is disposed between the nut 34 and the compressor wheel nose 13 such that the first washer 51 abuts the compressor wheel 14, and the second washer 61 is disposed between the first washer 51 and the nut 34. When the annular balance adjusting device 50 is assembled on the shaft 2 in this location and placed in the desired rotational orientation relative to the compressor wheel 14 and/or the shaft 2, the nut 34 is tightened on the shaft stub end 6 to an extent that the axial position and rotational orientation of the compressor wheel 14 and the annular balance adjusting device 50 are fixed relative to the shaft 2.

Referring to FIG. 8, the first side 52 (not shown) and second side 53 of the first washer 51, and the first side 62 and second side 63 (not shown) of the second washer 61 are generally planar and free of surface features. In this case, a surface friction force between the respective abutting surfaces of the second washer 61 with the first washer 51, and also of the first washer 51 with the compressor wheel nose 13 due the compressive axial force applied by the nut 34 serves to retain the annular balance adjusting device 50 in the desired rotational orientation relative to the compressor wheel 14, and also serves to retain the first washer 51 in the desired rotational orientation relative to the second washer 61.

However, depending on the requirements of the specific application, it may be beneficial to provide an additional mechanical connection (e.g., a mechanical connection that is in addition to that provided by surface friction) between the annular balance adjusting device 50 and the compressor wheel 14, and between the washers 51, 61 of the annular balance adjusting device 50 to prevent relative rotation once the annular balance adjusting device 50 is arranged in the desired configuration. For example, in some embodiments, the first washer 51 includes a first set of surface features 56 (not shown) on the first side 52 (not shown) thereof that are configured to cooperatively engage with surface features 17 (not shown) provided on the compressor wheel nose 13. The first washer 51 is retained a desired rotational orientation relative to the compressor wheel nose 13 via the engagement of the respective sets of surface features 17 (not shown), 56 (not shown). In addition, the first washer 51 includes a second set of surface features 57 on the second side 53 thereof that are configured to cooperatively engage with surface features 66 provided on a first side 62 of the second washer 61. The second washer 61 is retained in desired rotational orientation relative to the first washer 51 via the engagement of the respective sets of surface features 57, 66.

The sets of surface features 17 (not shown), 56 (not shown), 57, 66 provide increased mechanical connection between respective engaging surfaces 13, 52 and 53, 62. In addition, the sets of surface features may be configured to provide indexed adjustment by including fixed angles to which the washers 51, 61 can be set.

In some embodiments, the surface features may be in the form of stippling or radially extending grooves. In other embodiments, the mating sets of surface features are complementary rather than identical. This feature is illustrated in FIG. 8, in which the surface features 66 of the second washer 61 includes a series of equidistantly spaced surface features 66 in the form of detents formed on the first side 62 thereof, and the second set of surface features 57 of the first washer 51 include at least one protrusion formed on a second side 53 thereof.

Referring to FIG. 9, the annular balance adjusting device 50 can be secured to the shaft 2 via an alternative arrangement in which two nuts 34, 35 are serially disposed on the shaft stub end 6 outboard of the compressor wheel nose 13. As in the arrangement shown in FIG. 2, the annular balance adjusting device 50 is disposed between the compressor nose and the nut 34. In this alternative arrangement, however, the two adjacent nuts 34, 35 provide a self-locking member which secures the annular balance adjusting device 50 together with the compressor wheel 14 in a desired axial position and rotational orientation relative to the shaft 2.

Referring to FIG. 10, the annular balance adjusting device 50 can be secured to the shaft 2 via another alternative arrangement in which one nut 35 abuts the compressor wheel nose 13, and the compressor wheel 14 is secured to the shaft 2 via the nut 35 and independently of the annular balance adjusting device 50. In addition, the annular balance adjusting device 50 is disposed on the shaft 2 between the stub end 6 and a second nut 34, and the second nut 34 is disposed on the shaft 2 outboard of the annular balance adjusting device 50. The second nut 34 is threaded on the shaft stub end 6 and secures the annular balance adjusting device 50 to the shaft 2 in the desired rotational orientation.

Figure 11:
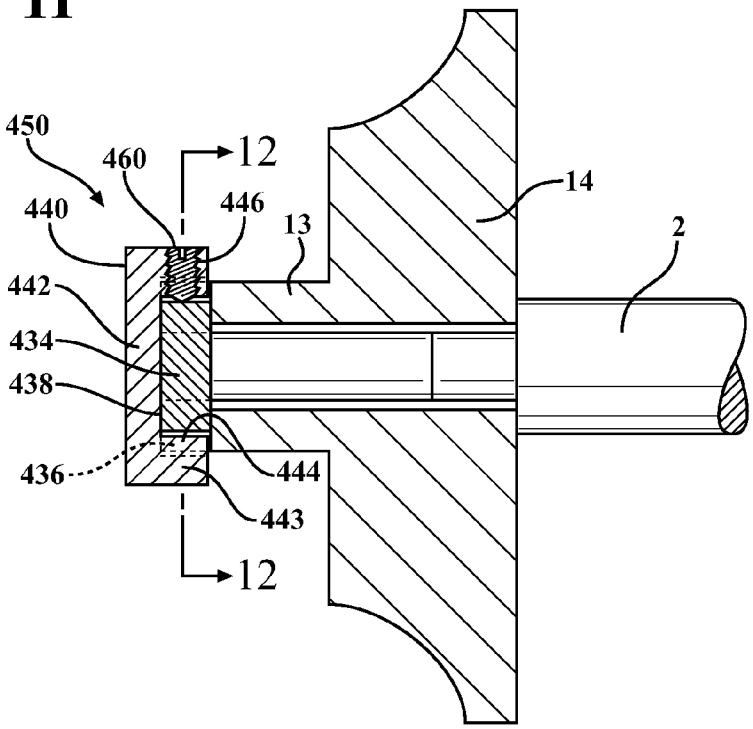
FIG. 11 is a side cross-sectional view of the compressor wheel end of the rotating assembly showing an alternative embodiment annular balance adjusting device.
Figure 12:
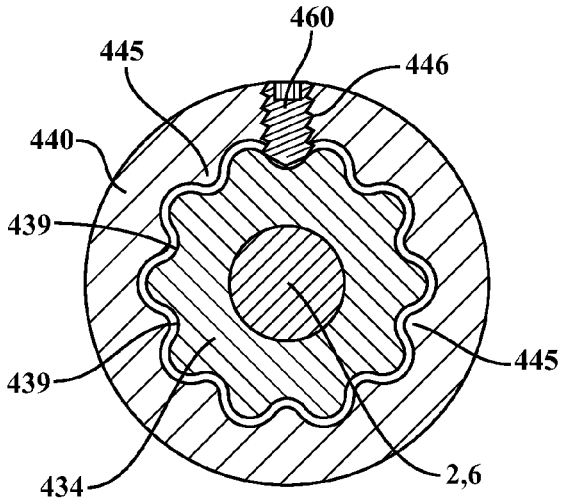
FIG. 12 is a cross-sectional view of the alternative embodiment annular balance adjusting device as seen along line 12-12 of FIG. 11.

Referring to FIGS. 11 and 12, an alternative annular balance adjusting device 450 includes a nut 434 that secures the compressor wheel 14 to the shaft 2, a collar 440 disposed on the nut 434, and a fastener 460 such as a set screw that secures the collar 440 to the nut 434. The collar 440 is generally a hollow cylindrical collar that is cup-shaped and includes a closed base 442 and a cylindrical sidewall 443 that extends normally from the closed base 442. The collar 440 has a predetermined, non-uniform weight distribution about a circumference thereof. The collar 440 encloses a portion of the nut 434 such that the closed base 442 abuts an axially outward-facing surface 438 of the nut 434, and the sidewall 443 surrounds at least a portion of the radially-outward facing surface 436 of the nut 434. In addition, an inner surface 444 of the sidewall 443 includes collar surface features 445 in the form of axially-elongated protrusions (e.g., ridges) that engage corresponding nut surface features 439 in the form of axially-extending grooves formed in the nut radially-outward facing surface 436. The cooperative engagement between the collar surface features 445 of the collar 440 and the nut surface features 439 of the nut 434 serve to retain the collar 440 in a selected rotational orientation relative to the nut 434, and thus relative to the shaft 2.

The fastener 460 is received within a radially-extending, threaded through hole 446 formed in the collar sidewall 443. The fastener 460 retains the collar 440 axially wherein the collar surface features 445 are engaged with the nut surface features 439. In some embodiments, the fastener 460 further functions to provide a desired imbalance to the collar 440. In other embodiments, the fastener 460 functions solely to retain the collar on the nut 434, and desired non-uniform weight distribution of the collar 440 is achieved by other methods, including, but not limited to, the methods described above with respect to the either of the washers 51, 61.

In use, the annular balance adjusting device 450 provides a predetermined imbalance to the rotating assembly (not labeled). In some cases, the predetermined imbalance provided by the annular balance adjusting device 450 is used to compensate for a measured imbalance of the rotating assembly (not labeled). In other cases, the predetermined imbalance is used to generate a desired imbalance in the rotating assembly (not labeled). The amount of imbalance is determined by the configuration of the collar 440 or the combination of the collar 440 and the fastener 460. The direction of imbalance is determined by the rotational orientation of the collar 440 relative to the nut 434. The rotational orientation of the collar 440 relative to the nut 434 can be adjusted by removing the fastener 460, sliding the collar 440 axially in an outboard direction so as to disengage the collar surface features 445 from the nut surface features 439 and remove the collar 440 from the nut 434, rotating the collar 440 to a desired rotational orientation corresponding to a desired imbalance, sliding the collar 440 axially in an inboard direction so as to re-engage the collar surface features 445 with the nut surface features 439, and securing the collar 440 relative to the nut 434 via the fastener 460.

Figure 13:
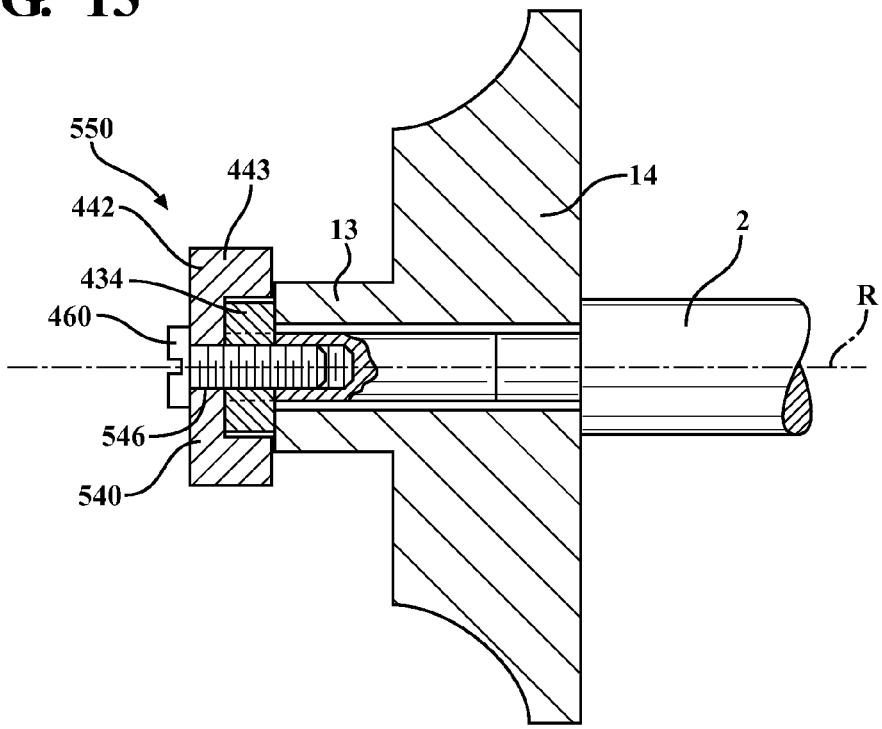
FIG. 13 is a side cross-sectional view of the compressor wheel end of the rotating assembly showing another alternative embodiment annular balance adjusting device.

Referring to FIG. 13, another alternative annular balance adjusting device 550 includes a nut 434 that secures the compressor wheel 14 to the shaft 2, a collar 540 disposed on the nut 434, and the fastener 460 such as a set screw or pin that secures the collar 540 to the nut 434. The annular balance adjusting device 550 shown in FIG. 12 is substantially similar to the annular balance adjusting device 450 shown in FIG. 11. For this reason common reference numbers will refer to common elements, and the description of the common elements will not be repeated. The annular balance adjusting device 550 shown in FIG. 12 differs from the annular balance adjusting device 450 only in that the fastener 460 extends axially rather than radially. To accommodate the axially-extending fastener 460, the collar 540 includes an axially-extending, threaded through hole 546 formed in the closed base 442 that receives the fastener 460. The through hole 546 is aligned with the rotational axis R of the shaft 2, whereby the fastener 460 does not affect the weight distribution of the collar 540.

Figure 14:
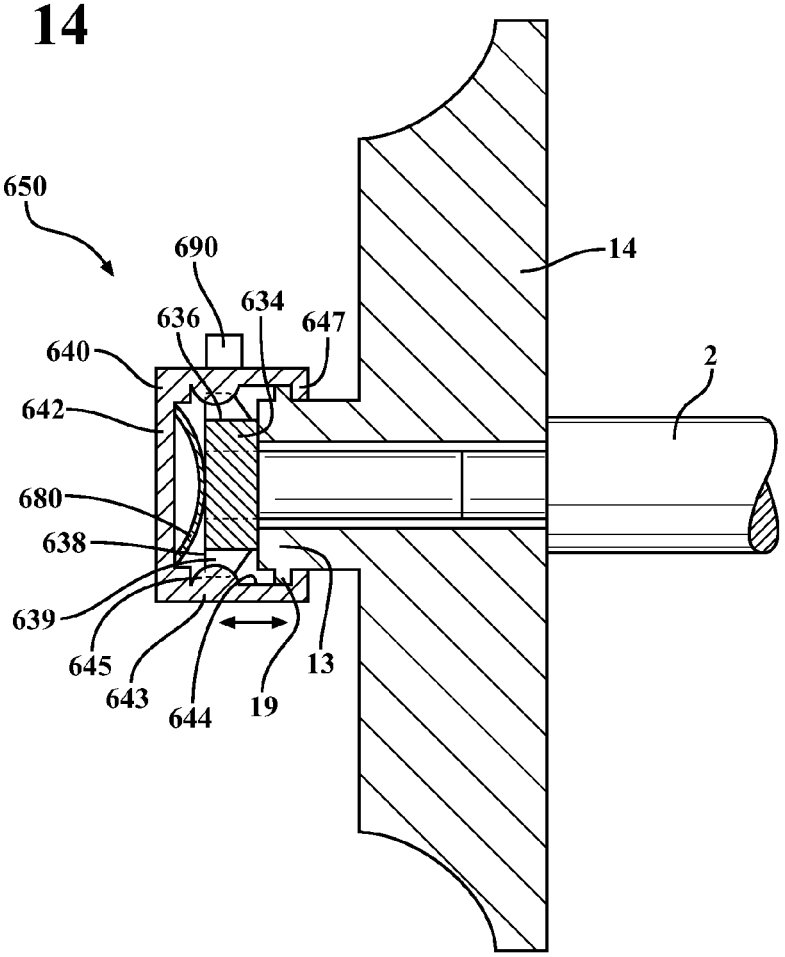
FIG. 14 is a side cross-sectional view of the compressor wheel end of the rotating assembly showing another alternative embodiment annular balance adjusting device.

Referring to FIG. 14, yet another alternative annular balance adjusting device 650 includes a nut 634 that secures the compressor wheel 14 to the shaft 2, a collar 640 disposed on the nut 634, and an elastic member 680 disposed between the nut 634 and the collar 640. The collar 640 is generally a hollow cylindrical collar that is cup-shaped and includes a closed base 642 and a cylindrical sidewall 643 that extends normally from the closed base 642. The collar 640 has a predetermined, non-uniform weight distribution about a circumference thereof. In the illustrated embodiment, the non-uniform weight distribution is achieved by securing a localized mass 690 to the sidewall 643, but is not limited to this configuration. The collar 640 encloses the nut 634 such that the closed base 642 faces an axially outward-facing surface 638 of the nut 634, and the sidewall 643 surrounds the entire radially outward-facing surface 636 of the nut 634. In addition, an inner surface 644 of the sidewall 643 includes collar surface features 645 in the form of axially-elongated protrusions (e.g., ridges) that engage corresponding nut surface features 639 in the form of axially-extending grooves formed in the nut radially outward-facing surface 636. The cooperative engagement between collar surface features 645 of the collar 640 and the nut surface features 639 of the nut 634 serve to retain the collar 440 in a selected rotational orientation relative to the nut 634, and thus relative to the shaft 2.

The collar sidewall 643 has a sufficient axial dimension to surround a portion of the nose 13 of the compressor wheel 14 when the closed base 642 is slightly axially spaced apart from the axially outward-facing surface 638 of the nut 634. In addition, an inwardly-protruding lip 647 is formed on an inner surface 644 of the collar 640. The nose 13 of the compressor wheel 14 is provided with a radially-outwardly protruding flange 19, and the inwardly-protruding lip 647 is disposed on the inner surface 644 of the collar 640 at a location that is inboard (e.g., closer to the bearing housing 8) relative to the radially-outwardly protruding flange 19. The inwardly-protruding lip 647 and the radially-outwardly protruding flange 19 overlap when viewed along an axial direction of the turbocharger 1.

The elastic member 680 is disposed under compression between the axially outward-facing surface 638 of the nut 634 and the base 642 of the collar 640, whereby the elastic spring force generated by the elastic member 680 urges the collar 640 away from the compressor wheel 14 to an extent that the inwardly-protruding lip 647 of the collar 640 engages the radially-outwardly protruding flange 19. In the illustrated embodiment, the elastic member 680 is a spring washer such as a Belleville washer, a wave washer, a curved disc spring, etc. However, the elastic member 680 is not limited to this type of spring. For example, in some embodiments, the elastic member 680 is a coil spring.

The collar 640 is configured to move axially relative to the compressor wheel nose 13 between a first axial position and a second axial position, and is urged to the first axial position by the presence of the elastic member 680. In the first position, the inwardly-protruding lip 647 is urged against the radially-outwardly protruding flange 19 via the spring force of the elastic member 680, and the collar 640 is axially retained on the compressor wheel nose 13 by engagement of the inwardly-protruding lip 647 with the radially-outwardly protruding flange 19. In addition, the rotational orientation of the collar 640 relative to the compressor wheel nose 13 is fixed via engagement of the nut surface features 639 of the nut 634 with the corresponding collar surface features 645 of the collar 640. In the second position, the inwardly-protruding lip 647 is axially spaced apart from the radially-outwardly protruding flange 19, and the nut surface features 639 no longer engage the corresponding collar surface features 645, so as to permit rotation of the collar 640 about the rotational axis R relative to the compressor wheel 14 and shaft 2.

In use, the annular balance adjusting device 650 provides a predetermined imbalance to the rotating assembly (not labeled). In some cases, the predetermined imbalance provided by the annular balance adjusting device 650 is used to compensate for a measured imbalance of the rotating assembly (not labeled). In other cases, the predetermined imbalance is used to generate a desired imbalance in the rotating assembly (not labeled). The amount of imbalance is determined by the configuration of the collar 640. The direction of imbalance is determined by the rotational orientation of the collar 640 relative to the nut 634. The rotational orientation of the collar 640 relative to the nut 634 can be adjusted by manually sliding the collar 640 axially in an inboard direction against the spring force generated by the elastic member 680 to the second axial position so as to disengage the collar surface features 645 from the nut surface features 639, rotating the collar 640 to a desired rotational orientation corresponding to a desired imbalance, releasing the collar 640 so as to permit the spring force to move the collar 640 axially to the first axial position whereby the collar surface features 645 are reengaged with the nut surface features 639.

Figure 15:
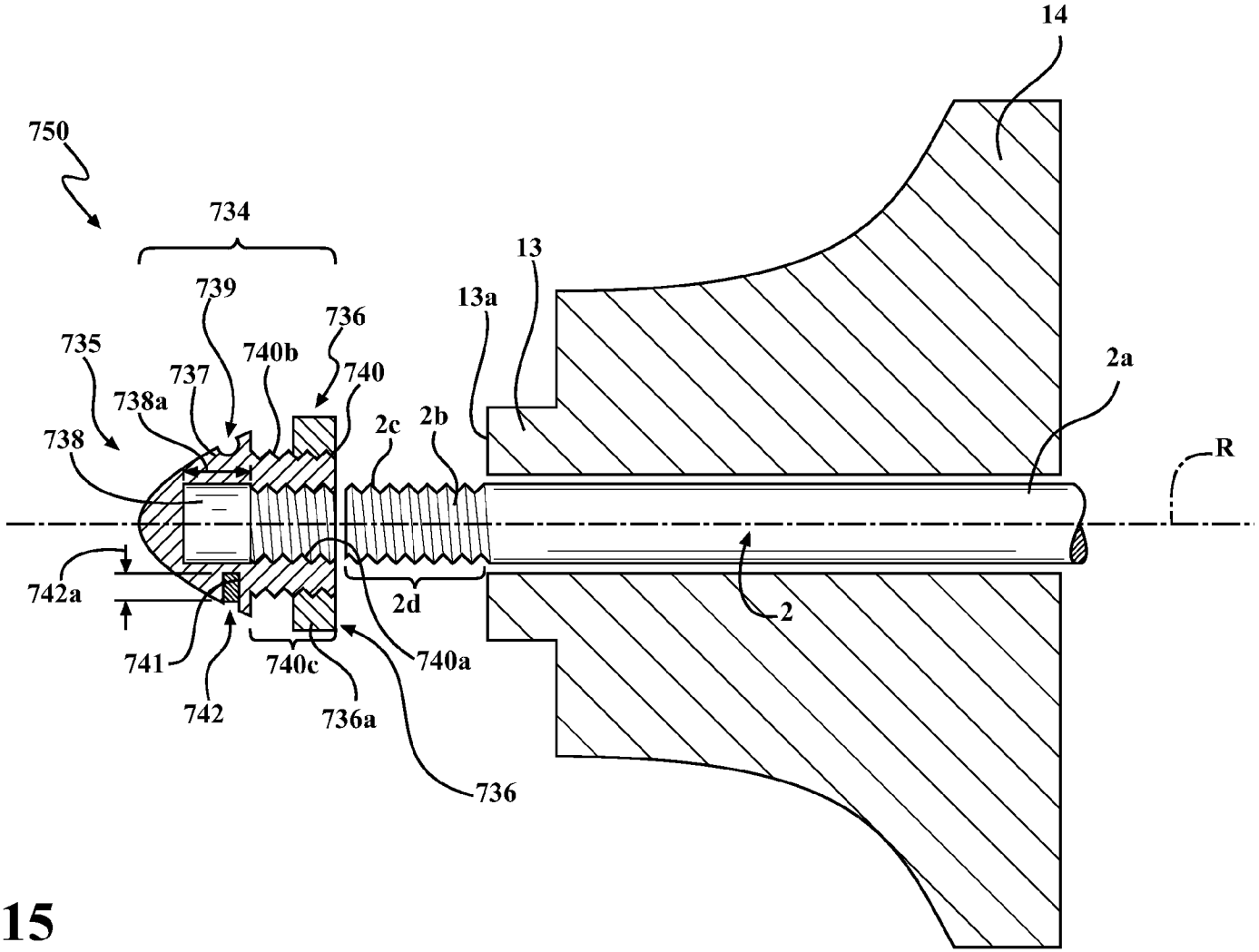
FIG. 15 is a side cross-sectional view of the compressor wheel end of the rotating assembly showing another alternative embodiment annular balance adjusting device.

Referring to FIG. 15, yet another alternative annular balance adjusting device 750 includes a nut assembly 734 that secures the compressor wheel 14 to the shaft 2. The nut assembly 734 includes a nose member 735 and an adjusting nut 736. The nose member 735 includes a cone-shaped head 737 and an integral collar 740. The integral collar 740 is cylindrical and includes interior surface features **740*a* and exterior surface features 740*b*. The interior surface features 740*a* and the exterior surface features 740*b* can be threads. The interior threads 740*a* mate with the shaft 2 (described in detail below) and the exterior threads 740*b* mate with surface features 736*a* formed on the interior of the adjustable nut 736. Surface features 736*a* can also be threads. The cone-shaped head 737 includes a cut-out 738. The cut-out 738 can also include surface features (not shown) that may be threads. The surface features (not shown) formed in the cut-out 738 can be formed at least partially or fully about a depth 738*a* of the cut-out 738. The cut-out 738 is aligned with the rotational axis R of the shaft 2, whereby the cone-shaped head 737 does not affect the weight distribution of the integral collar 740 about the shaft 2**.

The cone-shaped head 737 further includes an imbalance divot 739 and a test weight slot 741. The imbalance divot 739 can be any shape; however, a spherical or conical shape is preferable. The imbalance divot 739 can be machined, laser cut, or formed by electrical discharge machining (EDM) into the cone-shaped head 737; and the test weight slot 741 can be drilled, milled or reamed into the cone-shaped head 737. The test weight slot 741 can be tapered and/or include surface features (not shown) such as threads, and can have a depth **742*a*. The depth 742*a* of the test weight slot 741 can extend into the cut-out 738 or can have a dimension that prevents the test weight slot 741 from extending into the cut-out 738. A test weight 742 is included for receipt into the test weight slot 741. Test weight 742 can be inserted into the test weight slot 741 to a depth equal to, more than, or less than the depth 742*a* of the test weight slot 741. The test weight 742 can also have a taper which compliments the taper of the test weight slot 741; or the test weight 742 can include surface features (not shown) such as threads to allow the test weight 742 to be threaded into the test slot 741; or the test weight 742 can be press-fit into the test weight slot 741. Otherwise, the test weight slot 741 can be filled with weld material or a powdered metal that is sintered with a laser to ensure receipt of the test weight 742 within the test weigh slot 741**.

Shaft 2 includes a first portion 2*a* and a second portion 2*b*. The first portion 2*a* of the shaft 2 is a cylindrical shaft; however, the second portion 2*b* of the shaft 2 includes surface features 2*c* such as threads. The second threaded shaft portion 2*b* of the shaft 2 begins at an end 13*a* of the nose 13 of the compressor wheel 14 and the first cylindrical shaft portion 2*a* ends at the end 13*a* of the nose 13 of the compressor wheel 14. The second threaded shaft portion 2*b* of the shaft 2 has a depth 2*d* that can be equal to, less than, or slightly greater than a depth 740*c* of the integral collar 740. Threads 2*c* of the second threaded shaft portion 2*b* mate with the interior threads 740*a* of the integral collar 740.

In use, the annular balance adjusting device 750 provides a predetermined imbalance to the rotating assembly (not labeled). In some cases, the predetermined imbalance provided by the annular balance adjusting device 750 is used to compensate for a measured imbalance of the rotating assembly (not labeled). In other cases, the predetermined imbalance is used to generate a desired imbalance in the rotating assembly (not labeled). The amount of imbalance is determined by the configuration of the collar 640. The direction of imbalance is determined by the rotational orientation of the nose member 735 and the adjusting nut 736. The rotational orientation of the nose member 735 and the adjusting nut 736 can be adjusted by manually rotating the nose member 735 axially in an inboard direction with respect to the shaft 2 and adjusting nut 736.

The nose member 735 is threaded onto the second threaded shaft portion 2*b* of the shaft 2 on the compressor side of the rotor. The nose member 735 is threaded onto the second threaded shaft portion 2*b* of the shaft 2 with or without the test weight 742 disposed within the test slot and/or with or without the imbalance divot 739 formed into the cone-shaped head 737. The test weight 742 and the imbalance divot 739 can be used together or interchangeably depending upon the imbalance and amount of adjusting required. The nose member 735 is rotated close to the nose 13 of the compressor wheel 14. When the test weight 742 has been located at the desired angular position, the adjusting nut 736 is tightened onto the compressor wheel nose 13. The adjusting nut 736 is then torqued to a level that achieves the required clamping load with minimal migration and stresses that warrant optimal life of the rotor group. In practice, the diameter of the compressor wheel nose may need to be increased slightly in order to have sufficient clamping surface area, between adjusting nut 736 and compressor wheel 14.

Although the annular balance adjusting device 50 described with respect to FIGS. 1, 2, 9 and 10 includes first and second washer 51, 61 having an outer diameter that corresponds generally to an outer diameter of the compressor wheel nose 13, the first and second washers 51, 61 are not limited to this diameter. For example, in some embodiments, one or both of the first washer 51 and the second washer 61 have an outer diameter that is greater or less than that of the compressor wheel nose 13.

Although several methods for providing the washers 51, 61 and/or collars 440, 540, 640, 740 with the predetermined, non-uniform mass distribution have be described herein, the methods are not limited to those described, and the mass distribution of the washers 51, 61 and/or collars 440, 540, 640, 740 can be configured in other ways and by other methods than those described herein.

The annular balance adjusting device s and methods described herein are not limited to use in a turbocharger for adjustment of the imbalance level of the turbocharger rotating assembly (not labeled). For example, the annular balance adjusting devices and methods can be used to adjust the balance of an electric boost device having a turbine wheel connected to a compressor wheel via a common shaft, and further having an electric motor disposed between the turbine and compressor wheels and connected to the common shaft. In another example, the annular balance adjusting devices and methods can be used to adjust the balance of an electric boost device having a compressor wheel and electric motor having a common shaft.

Aspects of the disclosure have been described herein in an illustrative manner, and it is to be understood that the terminology used is intended to be in the nature of words of description rather than limitation. Many modifications and variations of the present disclosure are possible in light of the above teachings. It is, therefore, to be understood that within the scope of the appended claims, the disclosure may be practiced other than as specifically enumerated within the description.

What is claimed is:

1. A rotating assembly, comprising: a shaft comprising a first end, a second end and a rotational axis that extends through the first end and the second end, a turbine wheel rigidly connected to the second end of the shaft, a compressor wheel disposed on the shaft such that a nose of the compressor wheel is adjacent to the first end of the shaft, a nut that engages the first end of the shaft so as to secure the compressor wheel to the first end of the shaft, and an annular balance adjusting device disposed on the shaft between the nose and the first end of the shaft, wherein the annular balance adjusting device has a predetermined non-uniform mass distribution along its circumference, and is configured to be selectively rotated about the rotational axis relative to the nose so as to adjust the balance of the rotating assembly, and wherein the annular balance adjusting device comprises a first washer and a second washer that is selectively rotatable relative to the first washer, each of the first washer and the second washer having a predetermined non-uniform mass distribution along its respective circumference, and the first washer has a first set of surface features on a first side thereof that cooperate with surface features provided on the nose to retain the first washer in a desired rotational orientation relative to the nose, and a second set of surface features on a second side thereof that cooperate with surface features provided on the second washer to retain the first washer in a desired rotational orientation relative to the second washer.

2. The rotating assembly of claim 1, wherein the annular balance adjusting device is selectively rotatable about the rotational axis between predetermined discrete rotational orientations relative to the nose.

3. The rotating assembly of claim 1, wherein the first set of surface features comprise one of detents and protrusions, and the surface features provided on the nose comprise the other of the detents and the protrusions, and the second set of surface features comprise one of detents and protrusions, and the surface features provided on the second washer comprise the other of the detents and the protrusions.

4. The rotating assembly of claim 1, wherein the annular balance adjusting device is disposed on the shaft between the nut and the nose, and the nut is used to retain the annular balance adjusting device in a desired rotational orientation relative to the nose.

5. The rotating assembly of claim 1, wherein the annular balance adjusting device comprises a first washer, a second washer that is selectively rotatable relative to the first washer, each of the first washer and the second washer having a predetermined non-uniform mass distribution along its respective circumference, and a fastener that secures the first washer and the second washer to the shaft and maintains the first washer in a desired rotational orientation with respect to the second washer.

6. The rotating assembly of claim 1, wherein the first washer is axially adjacent to the second washer.

7. The rotating assembly of claim 1, wherein the nut comprises a first nut and a second nut, and wherein the first nut and the second nut are serially disposed on the first end of the shaft, and wherein the first nut and the second nut are constructed and arranged to provide a self-locking member to secure the annular balance adjusting device together with the compressor wheel in a desired axial position and rotational orientation relative to the shaft.

8. The rotating assembly of claim 1, wherein each of the first washer and the second washer has an outer diameter that corresponds to an outer diameter of the nose of the compressor wheel and an inner diameter that corresponds to an outer diameter of the second end of the shaft.

9. The rotating assembly of claim 1, wherein the first washer and the second washer are disposed directly on the shaft.

10. A Turbocharger comprising a bearing housing that rotatably supports a shaft including a first end, a second end and a rotational axis that extends through the first end and the second end, a turbine wheel that is rigidly connected to the second end of the shaft, a compressor wheel disposed on the shaft such that a nose of the compressor wheel is adjacent to the first end of the shaft, the compressor wheel, the turbine wheel and the shaft together providing a rotating assembly of the turbocharger, a nut that engages the first end of the shaft so as to secure the compressor wheel to the first end of the shaft, and an annular balance adjusting device disposed on the shaft between the nose and the first end of the shaft, wherein the annular balance adjusting device has a predetermined non-uniform mass distribution along its circumference, and is configured to be selectively rotated about the rotational axis relative to the nose so as to adjust the balance of the rotating assembly, and wherein the annular balance adjusting device comprises a first washer and a second washer that is selectively rotatable relative to the first washer, each of the first washer and the second washer having a predetermined non-uniform mass distribution along its respective circumference, and the first washer has a first set of surface features on a first side thereof that cooperate with surface features provided on the nose to retain the first washer in a desired rotational orientation relative to the nose, and a second set of surface features on a second side thereof that cooperate with surface features provided on the second washer to retain the first washer in a desired rotational orientation relative to the second washer.

* * * * *